US005207368A

United States Patent [19]

Wilfong, Jr. et al.

[11] Patent Number: 5,207,368

[45] Date of Patent: May 4, 1993

[54] DISPENSING APPARATUS FOR PLASTIC BAGS

[75] Inventors: Harry B. Wilfong, Jr., Hartsville; Richard A. Brown, Florence, both of S.C.

[73] Assignee: Sonoco Products Company, Hartsville, S.C.

[21] Appl. No.: 746,316

[22] Filed: Aug. 16, 1991

[51] Int. Cl.[5] ..... B26F 3/02

[52] U.S. Cl. ..... 225/106; 225/38; 225/46; 225/53; 225/90; 225/91; 206/390; 206/391; 221/26; 221/282

[58] Field of Search ..... 225/19, 38, 39, 46, 225/47, 53, 66, 90, 91, 106; 206/389, 390, 391, 397; 221/26, 283, 282

[56] References Cited

U.S. PATENT DOCUMENTS

| | | | |
|---|---|---|---|
| 383,578 | 5/1888 | King | 225/79 |
| 441,669 | 12/1890 | Jones | 225/23 |
| 826,666 | 7/1906 | Kaufman | 225/38 X |
| 1,579,814 | 4/1926 | Hellstrom | 221/45 |
| 2,646,877 | 7/1953 | Scholl | 206/409 |
| 2,657,873 | 11/1953 | Dittman et al. | 225/47 |
| 2,722,387 | 11/1955 | Tuttle | 225/38 X |
| 2,936,937 | 5/1960 | Guyer | 225/48 |
| 3,050,224 | 8/1962 | Drolshammer | 225/38 |
| 3,098,594 | 7/1963 | Williamson | 225/106 X |
| 3,156,356 | 11/1964 | McConnell | 206/409 |
| 3,166,187 | 1/1965 | Araujo | 242/55.53 |
| 3,176,892 | 4/1965 | Waltz | 225/66 |
| 3,517,870 | 6/1970 | Voytko | 225/34 |
| 3,702,672 | 11/1972 | Becht | 225/106 |
| 3,826,361 | 7/1974 | Heckrodt | 206/409 |
| 3,958,768 | 5/1976 | Fairbanks | 242/1 |
| 4,274,573 | 6/1981 | Finkelstein | 225/106 |
| 4,474,318 | 10/1984 | Perrin | 225/50 |
| 4,482,052 | 11/1984 | Wischusen, III | 206/409 |
| 4,685,633 | 8/1987 | Pellini | 206/389 X |
| 4,714,191 | 12/1987 | Richardson | 229/121 |
| 4,793,539 | 12/1988 | Haenni et al. | 225/106 |
| 4,850,486 | 7/1989 | Neibaur | 206/390 |
| 4,930,385 | 6/1990 | Wilfong, Jr. et al. | 225/106 |
| 5,118,022 | 6/1992 | Farahnik | 225/106 |
| 5,135,146 | 8/1992 | Simhaee | 225/91 X |

FOREIGN PATENT DOCUMENTS

| | | |
|---|---|---|
| 2597078 | 10/1987 | France . |
| 946077 | 1/1964 | United Kingdom . |

*Primary Examiner*—Frank T. Yost
*Assistant Examiner*—Raymond D. Woods
*Attorney, Agent, or Firm*—Bell, Seltzer, Park & Gibson

[57] ABSTRACT

A dispensing apparatus for serially dispensing flexible plastic bags from a wound package of bags which are joined along perforated severance lines, including a panel, and at least one elongate dispensing slot extending through the panel. The slot includes relatively narrow and linearly aligned outer edge portions, and a laterally extending tongue positioned between the outer edge portions. Also, an opening is located on one side of the tongue. In use, the opening is used to facilitate thread-up of the initial bag through the slot, and the two outer edge portions serve to engage and hold the bag in the slot. During withdrawal, the tongue engages the central portion of the bag, and when the tongue engages the next perforated severance line, or the bottom of the cut out in the case of T-shirt bags, a significant resistance is imparted which causes the severance line to rupture, with the next bag positioned in the slot and ready to be engaged and withdrawn.

14 Claims, 5 Drawing Sheets

DISPENSING APPARATUS FOR PLASTIC BAGS

FIELD OF THE INVENTION

The present invention relates to a dispensing apparatus adapted for serially dispensing flexible plastic bags from a wound package of bags which are joined along perforated severance lines.

BACKGROUND OF THE INVENTION

Commonly owned U.S. Pat. Nos. 4,793,539 and 4,930,385 disclose a dispensing nozzle for serially dispensing plastic grocery bags or the like from a supply roll and wherein the supply roll is composed of bags which are serially joined along perforated severance lines. The nozzles disclosed in the referenced patents include a slot of zig-zag configuration, together with a thread-up opening communicating with the slot, and the nozzle is disclosed as being mounted in the bore of a grocery store check-out countertop, with the bag supply roll being positioned below the countertop. In use, the leading edge of the initial bag on the roll is manually threaded through the thread-up opening, and the leading edge is then grasped and moved into the slot. Thereafter, the bags may be individually delivered by pulling the bags upwardly, and the zig-zag slot exerts sufficient resistance so as to cause a severing of the leading bag from the immediately following bag along the perforated severance line.

While the dispensing nozzles disclosed in the above referenced patents represent a significant advance in the art, they possess certain limitations in some specific applications. For example, the slots are sensitive to changes in bag size and thickness of the plastic film, and since the slot is relatively short, the bags are necessarily wrinkled as they are withdrawn. Further, existing metal check-out counters cannot be readily fitted with the nozzles.

It is accordingly an object of the present invention to provide an apparatus for serially dispensing flexible plastic bags of the described type, and which overcomes the above noted limitations of the prior nozzle designs.

It is also an object of the present invention to provide an apparatus for serially dispensing plastic bags and which includes a dispensing slot having a configuration which has sufficient width to accommodate the width of the bags being dispensed without significant wrinkling, and which provides a positive engagement with the bags to facilitate tearing off along the severance lines and while retaining the next bag in the slot in a ready-to-grasp position after separation.

It is a further object of the present invention to provide a bag dispensing apparatus of the described type which is easily threaded with the initial bag of the supply roll, and which accommodates reasonable changes in bag size or plastic film thickness.

SUMMARY OF THE INVENTION

The above and other objects and advantages of the present invention are achieved in the embodiments illustrated herein by the provision of a dispensing apparatus which comprises a panel, and at least one elongate dispensing slot extending through the panel. The slot includes relatively narrow and linearly aligned outer end portions, and a central portion which extends between the outer end portions. The central portion has a medial portion which lies at a level laterally offset from that of the outer end portions, so as to define a laterally extending tongue between the outer end portions. Preferably, the medial portion of the slot is relatively wide, to define a thread-up opening through the panel and on one side of the tongue. Further, the apparatus preferably includes means for rotatably mounting at least one wound package of bags adjacent the panel, with the package disposed along an axis extending generally parallel to the direction of the aligned outer end portions of the slot, and such that the bags may be serially unwound from the package and drawn through the slot.

In use, the thread-up opening on one side of the tongue permits the user to reach the adjacent roll of bags to facilitate the initial thread-up through the slot. Thread-up is then effected by drawing the two side edges of the initial bag into the two outer end portions of the slot, with the central portion of the bag being engaged by the tongue. The tongue imparts resistance to the withdrawal of the bag, particularly when the tongue engages the severance line, and so as to facilitate tearing along the severance line. In this regard, the tongue is particularly effective in the case of the so called T-shirt or handled bags, in that the tongue drops into the cut out opening between the handles of the following bag, and so as to impart significant resistance to further withdrawal when the tongue engages the bottom of the cut out opening. Upon tearing at the severance line, the outer end portions of the slot serve to retain the leading portion of the next bag so that it may be readily gripped and subsequently withdrawn.

BRIEF DESCRIPTION OF THE DRAWINGS

Some of the objects and advantages of the present invention having been stated, others will appear as the description proceeds, when taken in conjunction with the accompanying drawings, in which.

DETAILED DESCRIPTION OF THE PREFERRED EMBODIMENTS

Figure 1:
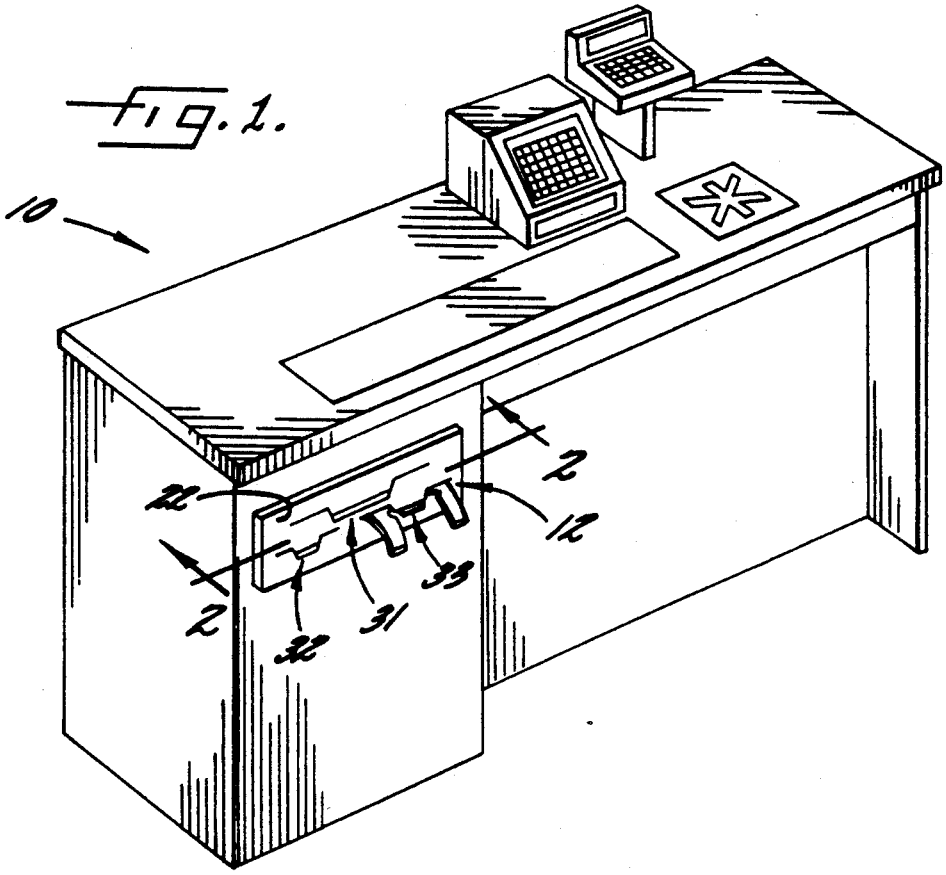
FIG. 1 is a perspective view of a store check-out counter, and which includes a bag dispensing apparatus in accordance with one embodiment of the present invention.
Figure 2:
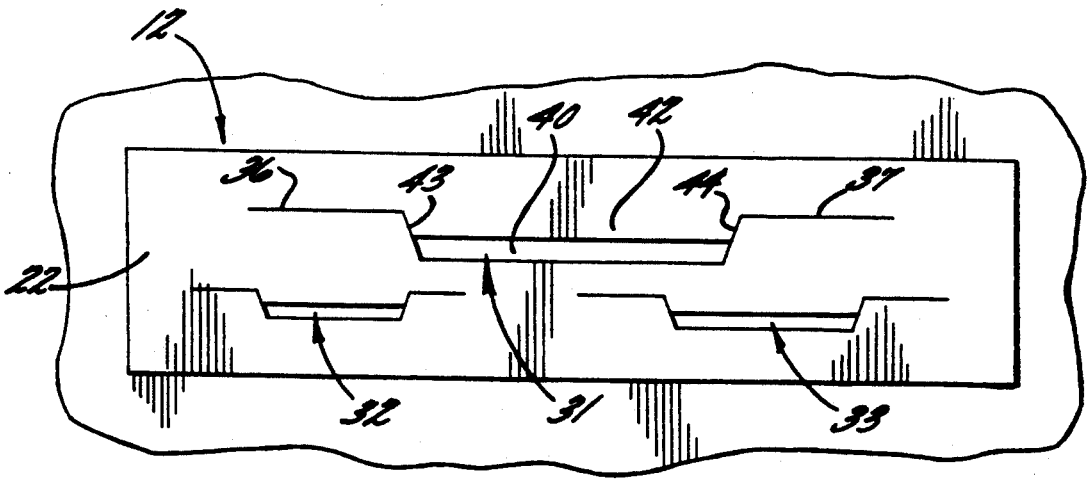
FIG. 2 is a fragmentary front plan view of the counter shown in FIG. 1 taken along line 2—2 and illustrating the front panel of the dispensing apparatus.
Figure 4:
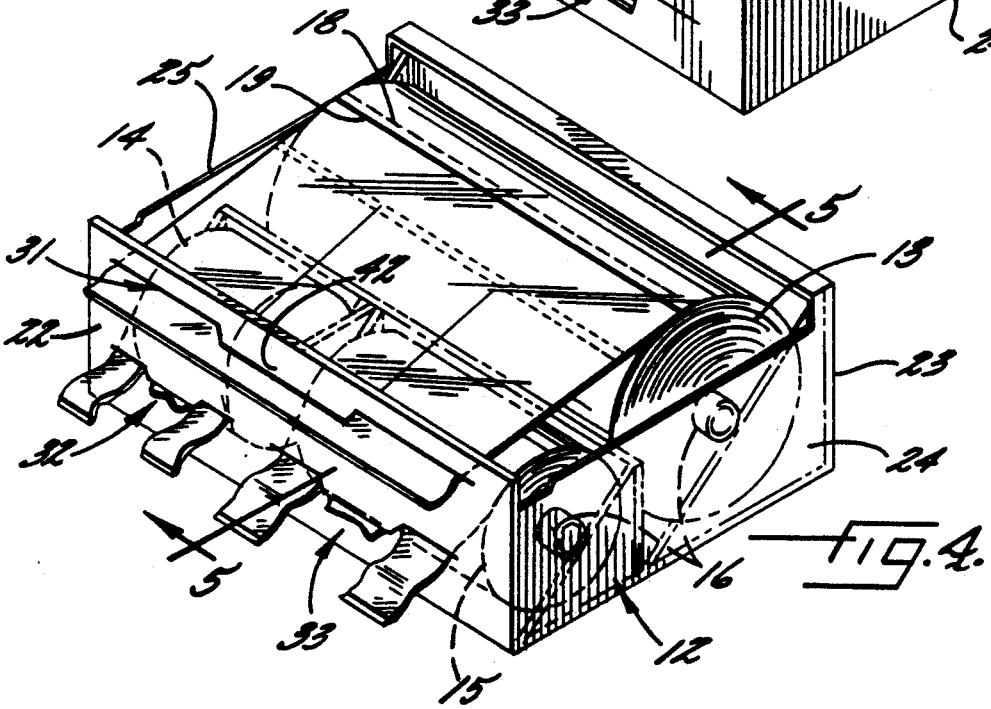
FIG. 4 is a view similar to FIG. 3, but also illustrating the wound packages of bags.

Referring more particularly to the drawings, FIG. 1 illustrates a conventional retail store check-out counter at 10, and which includes an apparatus 12 for selectively dispensing plastic bags from each of three wound supply packages 13, 14, and 15, note FIG. 4. As is conventional, the bags of each package are composed of a thin flexible plastic film, with the bags being wound on a tubular core 16, and serially joined along transverse perforated severance lines 18. The bags have a heat seal line 19 immediately adjacent and parallel to each severance line 18. The bags may be in a form having solid opposite side walls as shown on the package 13 in FIG. 4, or they may be in the form of T-shirt or handled bags, as shown on the packages 14 and 15 in FIG. 4 and on the packages shown in FIGS. 14 and 15. It is preferred that the bags of the three packages 13–15 be of different sizes.

The packages 13, 14 and 15 as illustrated in FIG. 4 are wound so that the open tops of the bags, which are formed at the severance lines 18, lead the closed bottoms, which are formed at the heat seal lines 19. It will be understood, however, that the present invention is equally applicable for dispensing bags from packages which are oppositely wound, i.e. where the closed bottoms lead the open tops.

In the embodiment of FIGS. 1–5, the dispensing apparatus 12 is in the form of a box-like structural member which may be slidably mounted in the check-out counter 10 in the manner of a conventional drawer. More particularly, the structural member includes a number of interconnected panels formed of plywood, sheet metal, or the like, and comprising a front panel 22, a rear panel 23, opposite side panels 24, 25, and a bottom panel 26. Also, there is provided an interior panel 27 which is parallel to the front and rear panels and which divides the interior into two compartments, and the front compartment is further divided by a second interior panel 28 which is perpendicular to the front panel 22 and the interior panel 27, with the second interior panel 28 being positioned to divide the front compartment and thereby form a total of three compartments.

Figure 3:
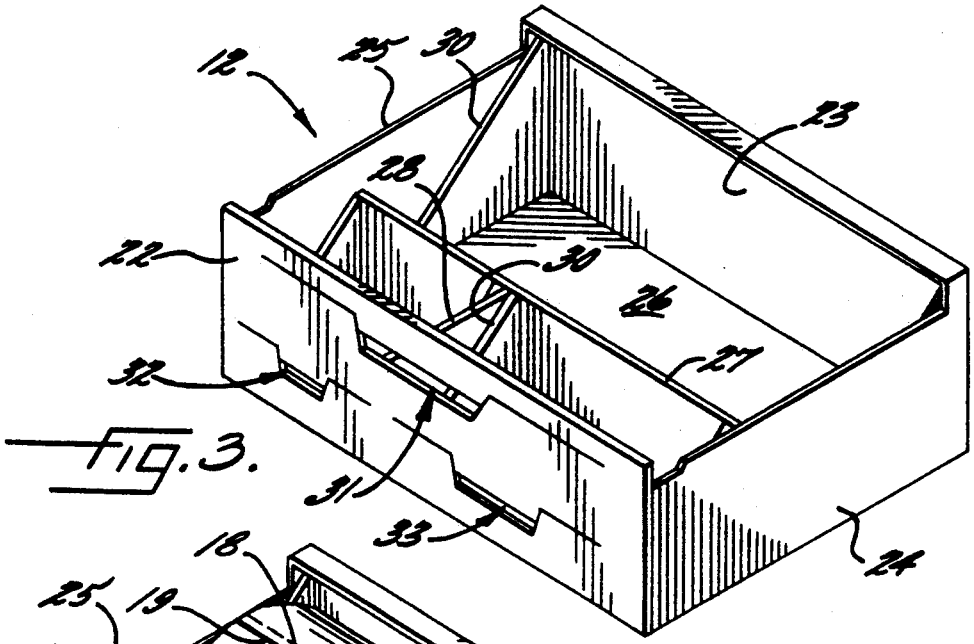
FIG. 3 is a perspective view of the dispensing apparatus of FIG. 1 shown withdrawn from the check-out counter.

As best seen in FIGS. 3 and 4, the three compartments are differently sized for rotatably receiving the differently sized wound packages 13, 14, 15 therein. In addition, the opposite ends of each compartment each mount an inclined edge surface 30 for engaging and supporting the tubular cores 16 of the wound packages, and to thereby limit lateral canting of the packages.

The front panel 22 includes three elongate dispensing slots 31, 32, 33 extending therethrough, with each slot being adapted for dispensing the bags from respective ones of the packages 13, 14, 15. Each slot 31–33 has relatively narrow and linearly aligned outer end portions 36, 37 which extend in a straight line along a predetermined horizontal direction, and a central portion extending between the outer end portions. More particularly, the central portion is composed of a medial portion 40 which lies at a level which is laterally offset from, i.e. below in the illustrated embodiment, that of the outer end portions 36, 37 and extends along a line parallel to the predetermined horizontal direction, so as to define a laterally depending tongue 42 between the outer end portions. The central portion further includes opposite interconnecting portions 43, 44 which extend generally upwardly and which respectively join the medial portion 40 to the outer end portions 36, 37. The medial portion 40 of the slot is relatively wide, and defines a thread-up opening through the panel and laterally below the depending tongue 42.

Figure 5:
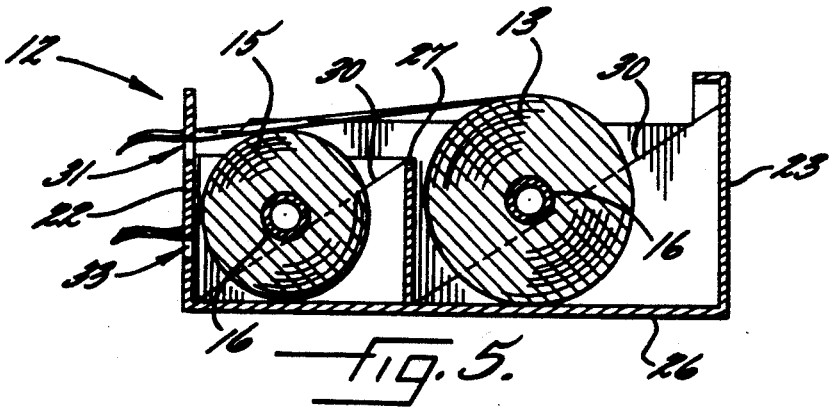
FIG. 5 is a sectional view taken substantially along the line 5—5 of FIG. 4.

In use, the three wound supply packages 13–15 of plastic bags are disposed in the three compartments as seen in FIGS. 4 and 5, with the bags of the two packages 14, 15 in the front compartments being threaded through the slots 32, 33 respectively. The largest package 13 is disposed in the rear compartment, and the leading bag extends over the two front packages and is threaded through the slot 31. As will be noted, the width of the three slots varies, so as to generally conform to the width of the bags being dispensed.

The functional aspects of the bag thread-up and dispensing operations for the three slots are identical. Specifically, to effect thread-up, the initial bag is drawn through the thread-up opening, and the two side edges of the bag are drawn into the two outer end portions 36, 37 of the associated slot, with the central portion of the bag being engaged and depressed by the tongue 42. Upon pulling the bag outwardly, the bag initially moves freely through the slot but resistance to such movement increases when the tongue engages the perforated severance line 18 between the outer bag being pulled and the next bag. This resistance permits the ready severance of the outer bag at the line 18, leaving a portion of the next bag extending through the slot in a position to be readily gripped for subsequent withdrawal.

While the tongue 42 is illustrated as extending downwardly from the line defined by the outer end portions 36, 37, it will be understood that the tongue could be positioned above such line with equally good results. Further, the slots and packages could be vertically oriented rather than horizontally as shown.

Figure 6:
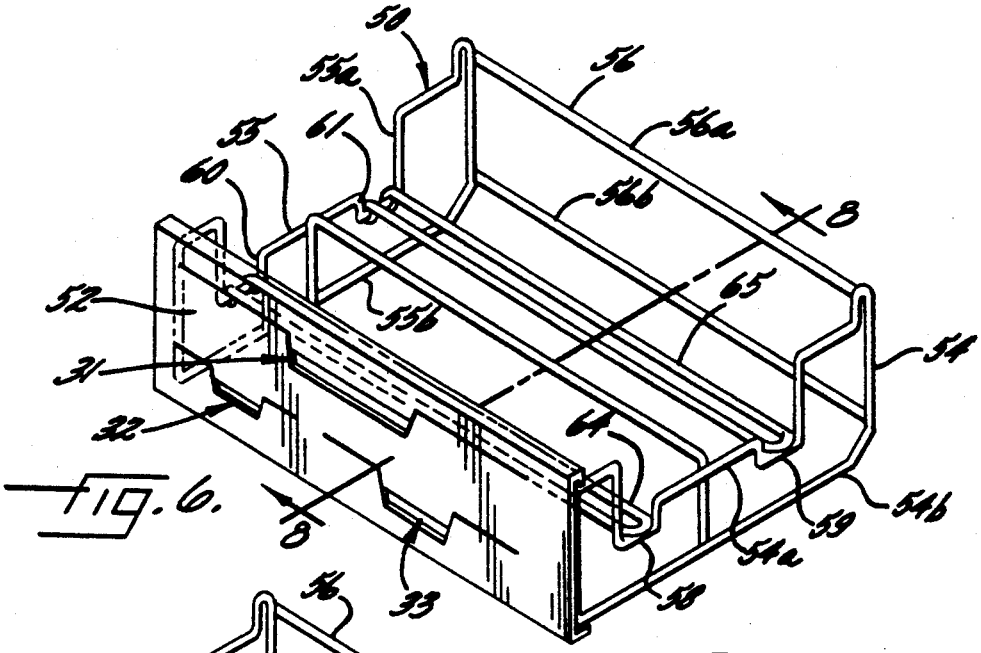
FIG. 6 is a perspective view of a second embodiment of a dispensing apparatus in accordance with the present invention and which is adapted for use with a check-out counter as shown in FIG. 1.
Figure 7:
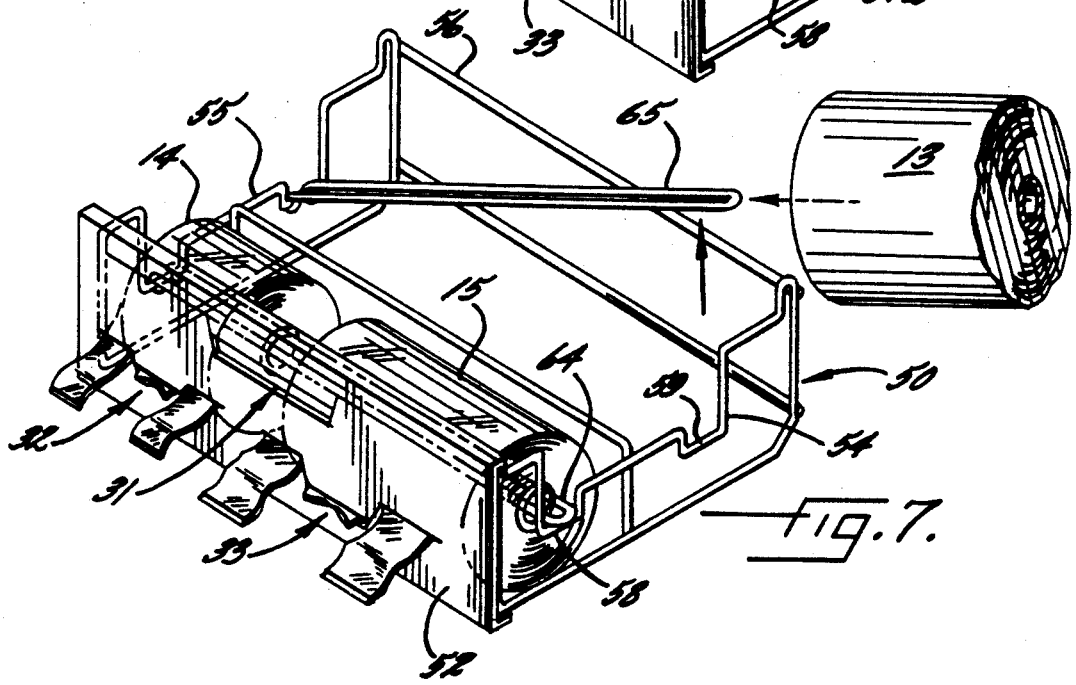
FIG. 7 is a view similar to FIG. 6 but showing one of the wound packages being loaded onto the apparatus and two of the packages in their operative position.
Figure 8:
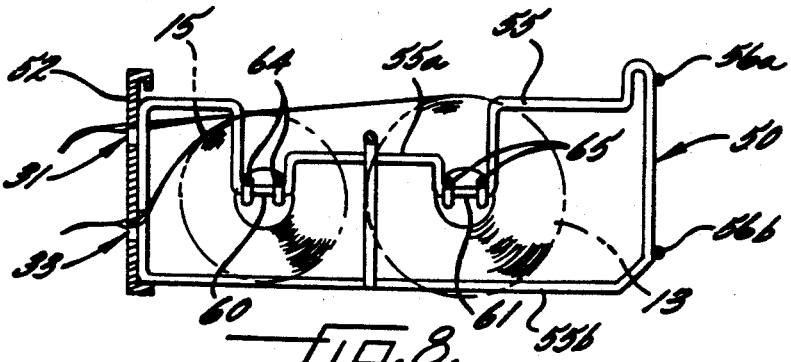
FIG. 8 is a sectional view taken substantially along the line 8—8 of FIG. 6.

FIGS. 6–8 illustrate a second embodiment of the invention and wherein the structural member is generally rectangular in outline and comprises a framework 50 of rod-like members configured to define three sides of the member, and a front panel 52 joined to the framework and defining a fourth side of the member. The framework 50 of rod-like members includes two sides 54, 55, with the side 54 composed of upper and lower rods 54*a*, 54*b*, and the side 55 composed of upper and lower rods 55*a*, 55*b*. A rear side 56 is also provided which is composed of upper and lower rods 56*a*, 56*b*.

The upper rod 54*a* of the side 54 includes a pair of U-shaped notches 58, 59, and the upper rod 55*a* includes a pair of U-shaped notches 60, 61, which are laterally aligned with the notches 58, 59 respectively. An elongate probe 64 extends between the aligned pair of notches 58, 60 so as to extend generally parallel to the front panel, and a second elongate probe 65 extends between the notches 59, 61. More particularly, each probe 64, 65 is pivotally mounted at the notch 60, 61 respectively of the upper side rod 55*a*, and the free end of each probe 64, 65 is adapted to rest in the notch 58, 59 respectively of the other upper side rod 54*a*. When either probe 64, 65 is pivoted upwardly as seen in FIG. 7, it is adapted to coaxially receive a wound package of bags thereupon. Also, as illustrated, the front probe 64 is adapted to mount two packages of different size.

The structural member of the embodiment of FIGS. 6–8 is also in a form which permits it to function as a drawer in a check-out counter as seen in FIG. 1. Further, the front panel 52 includes three slots 31, 32, 33 which conform to the structure as described above with respect to the embodiment of FIGS. 1–5.

FIGS. 9–15 illustrate another embodiment of the present invention, and wherein the apparatus takes the form of a carton 70 which may be fabricated of corrugated paper or similar material. The carton 70 defines a box-like enclosure, which comprises front and rear panels 71, 72, top and bottom panels 73, 74, and opposite side panels 75, 76.

Figures 9, 10, 11, 12:
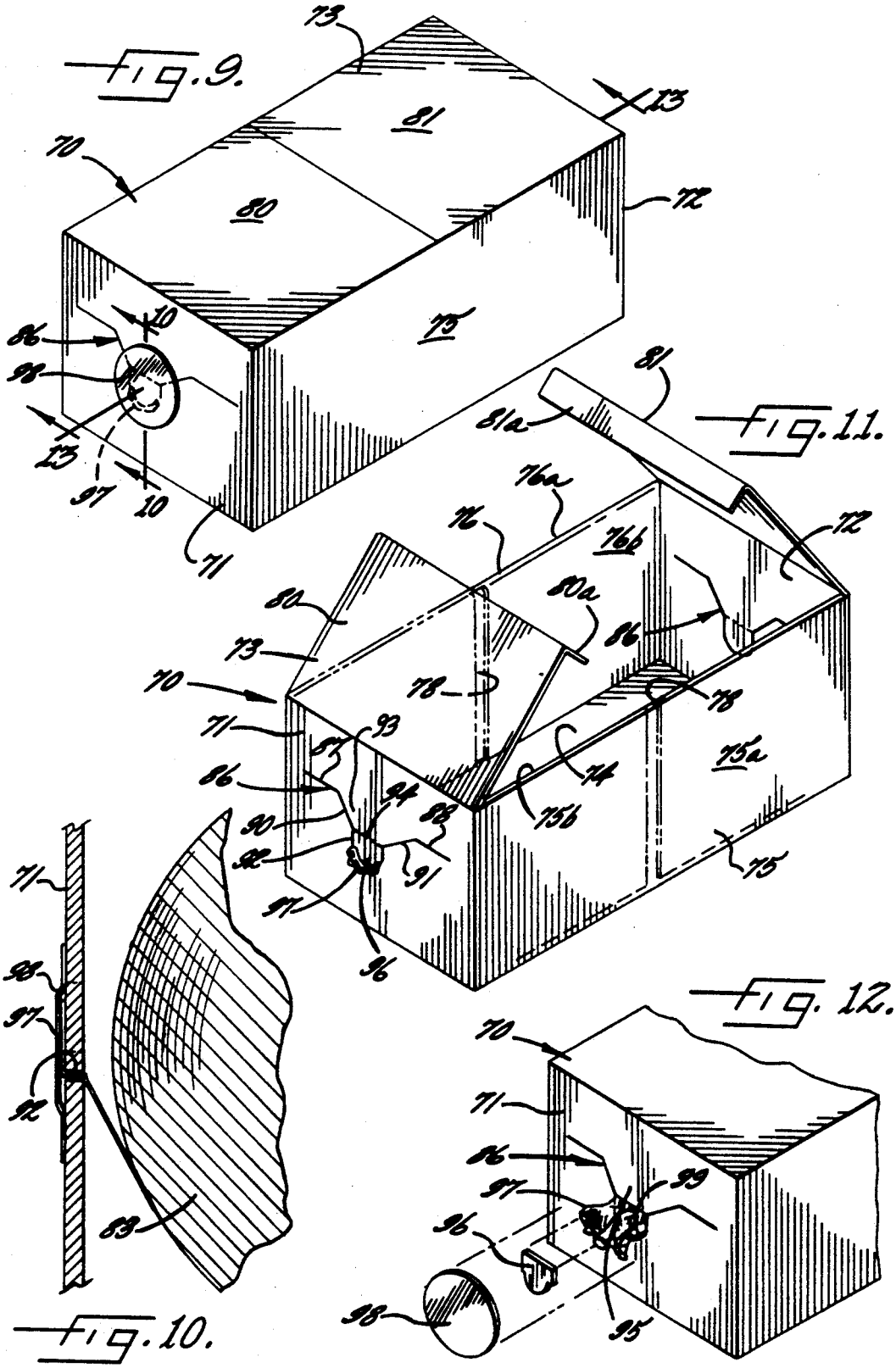
FIG. 9 is a perspective view of another embodiment of the bag dispensing apparatus of the present invention which is in the form of an enclosed carton.
FIG. 10 is a fragmentary enlarged sectional view taken along the line 10—10 of FIG. 9.
FIG. 11 is a view similar to FIG. 9 but illustrating the internal construction of the carton.
FIG. 12 is an exploded perspective view similar to FIG. 9 but illustrating the apparatus in its operative position.

As best seen in FIG. 11, the two side panels 75, 76 each comprise an outer wall member **75*a*, 76*a*, and an inner wall member 75*b*, 76*b* which is joined to the outer wall member along the top edge thereof so that the inner wall member may be folded into the illustrated overlying relationship with respect to the outer wall member. Also, each inner wall member 75*b*, 76*b* includes a vertical slit 78** at a medial location along the longitudinal length of the enclosure for the purposes described below.

The top panel 73 of the enclosure is composed of two oppositely directed flaps 80, 81 which are joined to the top edge of the front and rear panels 71, 72 respectively. The flaps each include a downwardly directed skirt portion **80*a*, 81*a* which fits in the aligned slits 78 of the inner wall members. Thus when the flaps 80, 81 are closed as seen in FIG. 9, the skirt portions serve to divide the interior into two compartments. Also, a wound package 83, 84 of flexible plastic bags is disposed in each compartment, and such that the axis of each package defines a predetermined direction which is parallel to the front and rear panels and extends between the opposite side panels 75, 76**.

The front panel 71 and the rear panel 72 each include a dispensing slot 86 of like configuration. Each such slot 86 has an initial configuration as seen in FIGS. 9 and 10, which is maintained during shipment of the carton to the user. In this initial configuration, the slot includes relatively narrow and linearly aligned outer end portions 87, 88 which extend in a direction parallel to the predetermined direction defined by the axes of the packages 83, 84. Also, the slot includes a generally U-shaped central portion which interconnects the outer end portions, and which defines a laterally extending appendage 93. A perforation line 94 extends across the medial portion of the appendage and in a direction generally parallel to the above predetermined direction. The portion 95 of the appendage 93 which is above the perforation line 94 in the illustrated embodiment is also bounded by a pair of oppositely inclined interconnecting portions 90, 91 of the slot. Also, the portion 96 of the appendage below the perforation line 94 is adapted to be manually removable by the user to form a bag thread-up opening 99 through the panel 71 and which communicates with the slot, and the portion 95 of the depending appendage 93 above the perforation line 94 then defines a depending tongue (note FIG. 12) which functions in the manner described above with respect to the embodiments of FIGS. 1–8.

The carton 70 is fabricated by initially preparing the enclosure with the flaps 80, 81 open, so that two wound packages 83, 84 may be positioned therein in a parallel arrangement. Before closing and sealing the flaps 80, 81, the manufacturer manually inserts the leading edge of the initial bag of each package into the adjacent slot at the bottom of the appendage, and so that a portion 97 of the bag extends through the slot and is located on the outer side of the front panel 71. The removable portion 96 is not removed by the manufacturer. Also, a protective sticker 98 is adhered to the outer surface so as to overlie and protect the removable portion 96 and the exposed portion 97 of the leading bag. The flaps 80, 81 are then closed and preferably secured by tape (not shown), and the carton is then in a configuration ready to be shipped to the ultimate user.

When the carton reaches the ultimate user, which typically is a store clerk, the sticker 98 is removed and the removable lower portion 96 of the appendage 93 is also removed by pushing it inwardly. This results in a formation of an opening 99 below the remaining portion of the appendage, i.e. the tongue. The bag may then be readily threaded into the slot to the position shown in FIG. 15. In the event the leading edge of the leading bag should inadvertently slip rearwardly through the slot, the user may conveniently reach through the opening to grasp and withdraw the bag.

Figure 14:
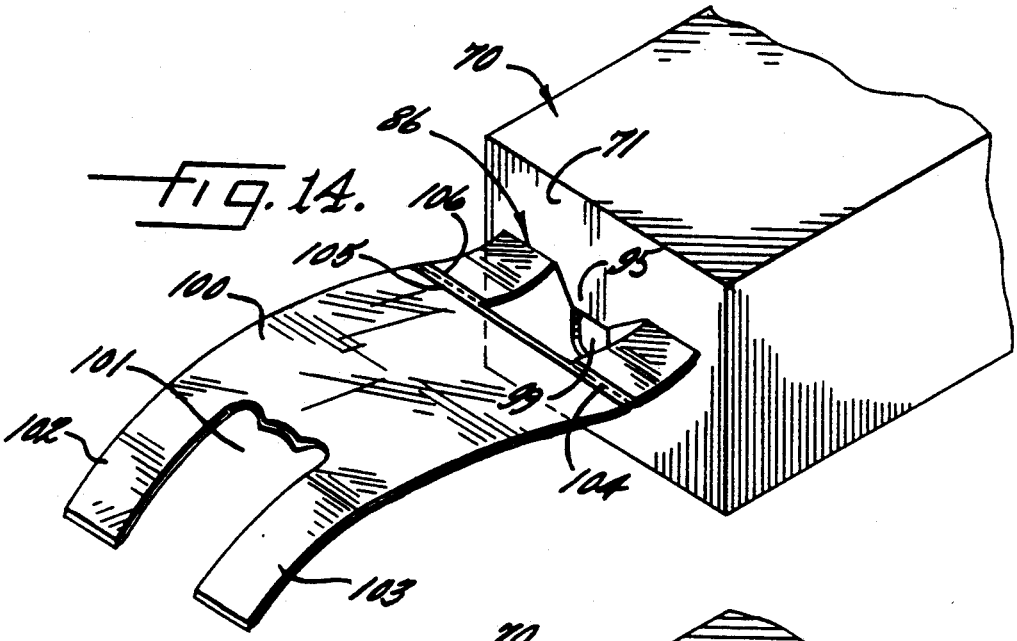
FIGS. 14 and 15 illustrate the operative steps of the bag dispensing procedure for the carton.
Figure 15:
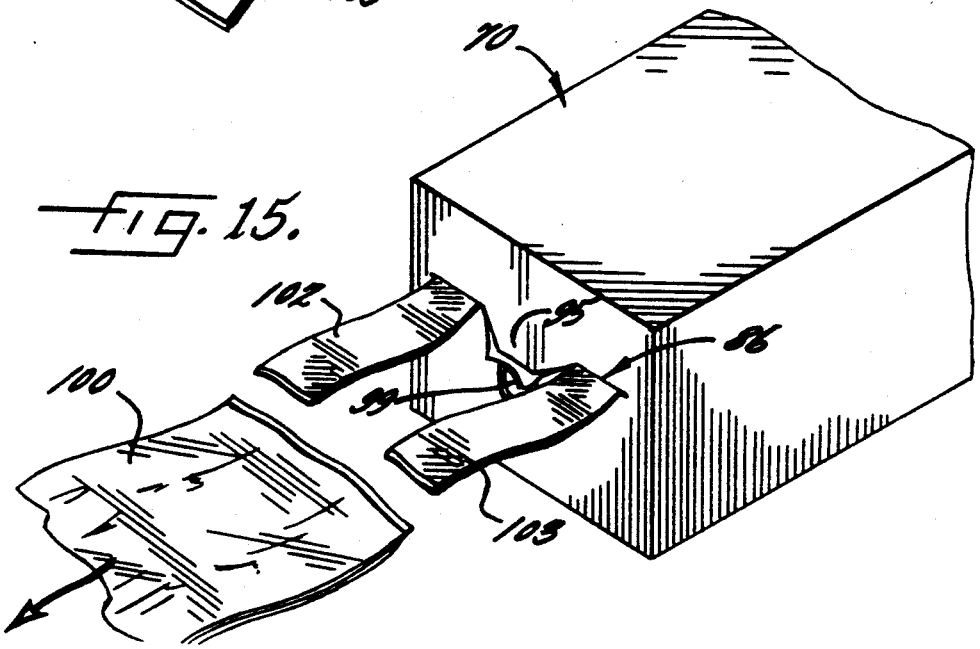

FIGS. 14 and 15 illustrate the steps involved in the withdrawal of a bag 100 of the T-shirt or handled type. As is conventional, such bags include a cut out 101 which defines the open top of the bag and two handles 102, 103, and the bags include a perforated severance line 104 at the base of each bag and at the tops of the handles of the next bag. Also, a continuous heat sealed line 105, 106 is positioned on each side of the severance line.

As the leading bag is pulled through the slot, the tongue formed by the upper portion 95 of the appendage 93 will drop into the cut out portion 101 of the following bag (FIG. 14), and will later engage the bottom edge of the cut out portion (FIG. 15). At this point, the tongue will impart significant resistance to the withdrawal, resulting in the rupture of the severance line 104. The handles of the next bag are thus in a position to be easily grasped and subsequently withdrawn in the same manner.

As illustrated, the packages 83 and 84 are wound so that the open tops of the bags lead the closed bottoms, but it will be understood that the orientation of the bags may be reversed in the packages. When the closed bottoms precede the open tops, the tongue 95 will drop into the opening 101 between the handles during the withdrawal process and will engage the bottom edge of the next bag. However, before severance occurs, it has been found that the corners of the next bag will extend through the outer end portions 86, 87 of the slot a sufficient distance to permit grasping and withdrawal of the next bag.

In the case of a solid bag (as opposed to the T-shirt or handled type) the tongue will slide along the central portion of the bag as it is withdrawn until it engages the perforated severance line, which increases its resistance and thus facilitates the rupture along the severance line. Here again, it has been found that before rupture occurs, the corners of the next bag will extend through the outer end portions of the slot sufficiently to permit grasping and withdrawal of the next bag.

Figure 13:
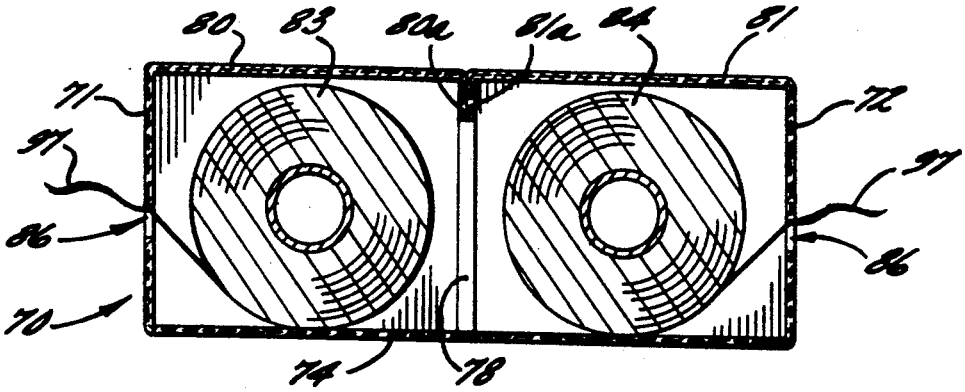
FIG. 13 is a longitudinal sectional view of the carton taken substantially along the line 13—13 of FIG. 9.

As best seen in FIG. 13, the packages 83 and 84 are disposed so that the leading end of the bags are withdrawn from the bottom of the packages, rather than the top as shown in the embodiments of FIGS. 1–8. Positioning the bags as shown in FIG. 13 is advantageous in that the packages tend to roll away from the front panel 71 during withdrawal of the bags, which minimizes binding. However, this advantage would not preclude effective use of the carton 71 turned upside down from the orientation shown in FIG. 13.

In the drawings and specification, there has been set forth a preferred embodiment of the invention, and although specific terms are employed, they are used in a generic and descriptive sense only and not for purposes of limitation.

That which is claimed is:

1. A dispensing apparatus for serially dispensing flexible plastic bags from a wound package of bags joined along perforated severance lines, and comprising a panel, at least one elongate dispensing slot extending through said panel, said slot including relatively narrow outer end portions and a central slot portion extending between said outer end portions, said central slot portion having a medial portion relatively wider than said outer end portions and defining a thread-up opening through said panel, said medial portion of said central slot portion being laterally offset from said outer end portions and defining a laterally extending tongue between said outer end portions for separating the serially joined bags.

2. The dispensing apparatus as defined in claim 1 wherein said medial portion of said slot has at least one edge which is generally linear and parallel to said outer end portions, and wherein said central portion of said slot further includes opposite interconnecting portions which respectively join said one edge of said medial portion to said outer end portion.

3. The dispensing apparatus as defined in claim 1 further comprising means for rotatably mounting at least one wound package of flexible plastic bags adjacent said panel and along an axis extending generally parallel to said outer end portions of said slot, and such that the bags are serially unwound from said package and drawn through said slot.

4. A dispensing apparatus for serially dispensing flexible plastic bags from a plurality of wound packages of bags joined along perforated severance lines, and comprising a box-like structural member including a front panel, a rear panel, and opposite side panels, and a first interior panel which extends between said side panels and is parallel to said front panel and which divides the interior of said structural member into two compartments which are suitable for rotatably receiving a wound package of bags therein with the axes of the wound packages being parallel to each other and to said front panel, at least a pair of elongate dispensing slots extending through said front panel, each said slot including relatively narrow outer end portions, and a central slot portion extending between said outer end portions, said central slot portion having a medial portion relatively wider than said outer end portions and defining a thread-up opening through said panel, said medial portion of said central slot portion being laterally offset from said outer end portions and defining a laterally extending tongue between said outer end portions for separating the serially joined bags, whereby a pair of the wound packages are positioned in the two compartments and the bags thereof threaded through respective ones of said slots.

5. The dispensing apparatus as defined in claim 4 wherein said box-like structural member is configured to define a drawer which is slidably mounted in a cabinet, with said front panel serving as the front of the drawer.

6. The dispensing apparatus as defined in claim 5 wherein said structural member further includes a second interior panel which is perpendicular to said front panel and to said first interior panel and to thereby form a total of three compartments, and wherein said front panel includes three of said slots, and so that the structural member accommodates and dispenses three of the wound packages.

7. A dispensing apparatus for serially dispensing flexible plastic bags from a wound package of bags joined along perforated severance lines, and comprising a box-like structural member comprising a framework of rod-like members configured to define three sides of the structural member, and a front panel joined to said framework and defining a fourth side of the structural member, said framework including at least one elongate probe extending generally parallel to said front panel and having a free end for coaxially receiving a wound package of bags thereupon, at least one elongate dispensing slot extending through said front panel, said slot including relatively narrow outer end portions extending in a direction parallel to said probe, and a central slot portion extending between said outer end portions, said central slot portion having a medial portion relatively wider than said outer end portions and defining a thread-up opening through said panel, said medial portion of said central slot portion being laterally offset from said outer end portions and defining a laterally extending tongue between said outer end portions for separating the serially joined bags, whereby the wound package is positioned on the probe of said framework and the bags thereof threaded through said one slot.

8. The dispensing apparatus as defined in claim 7 wherein said framework includes a pair of side rods extending along opposite sides of the structural member and perpendicularly to said front panel, and wherein said probe has its end opposite said free end pivotally mounted to one of said side rods so as to permit the probe to be pivoted between an operative position wherein the free end thereof is in contact with the other side rod and a raised position which permits the wound package to be coaxially received thereupon.

9. The apparatus as defined in claim 8 wherein said framework includes a pair of said probes which are mounted in a parallel relationship, and wherein said front panel includes a plurality of said slots, and so that the apparatus accommodates and dispenses a plurality of the wound packages.

10. A dispensing carton for serially dispensing flexible plastic bags from a wound package of bags joined along perforated severance lines, and comprising a box-like enclosure comprising front and rear panels, top and bottom panels, and opposite side panels, with said enclosure being sized so as to receive at least one wound package of bags therein, an elongate dispensing slot extending through said front panel, said slot including relatively narrow outer end portions, and a central slot portion extending between said outer end portions, said central slot portion having a medial portion relatively wider than said outer end portions and defining a thread-up opening through said panel, said medial portion of said central slot portion being laterally offset from said outer end portions and defining a laterally extending tongue between said outer end portions for separating the serially joined bags, whereby the wound package is positioned in said enclosure and the bags thereof threaded outwardly through said slot.

11. The dispensing carton as defined in claim 10 wherein said rear panel of said enclosure includes another said dispensing slot extending therethrough, and wherein said enclosure is sized to receive a second wound package therein and adjacent said rear panel, and such that the bags of the second wound package are threaded outwardly through the slot of said rear panel.

12. A dispensing carton for serially dispensing flexible plastic bags, and comprising a box-like enclosure comprising front and rear panels, top and bottom panels, and opposite side panels, a wound package of flexible plastic bags joined along perforated severance lines, said package being positioned in said enclosure and such that the axis of the package defines a predetermined direction, an elongate dispensing slot extending through said front panel, said slot including relatively narrow outer end portions which extend in a direction parallel to said predetermined direction, and a generally U-shaped central portion extending between said outer end portions and defining a laterally extending appendage, a perforation line extending across a medial portion of said appendage and in a direction generally parallel to said predetermined direction, and wherein a portion of said appendage between said perforation line and said outer end portions defined a laterally extending tongue and a portion of said appendage on the other side of said perforation line is manually removable to form a central slot portion extending between said outer end portions, said central slot portion having a medial portion relatively wider than said outer end portions and defining a thread-up opening through said front panel, said medial portion of said central slot portion being laterally offset from said outer end portions and defining said laterally extending tongue for separating the serially joined bags.

13. The dispensing carton as defined in claim 12 wherein a leading edge of an initial bag on said wound package is wedged in said slot below said perforation line and is exposed on an outer side of said front panel, to facilitate gripping and thread-up of the initial bag into said slot when the removable portion of said appendage is removed.

14. The dispensing carton as defined in claim 13 further comprising a removable sticker adhered to the outer side of said front panel and overlying at least the removable portion of said appendage to thereby protectively cover the exposed leading edge of the initial bag until the carton is ready for use.

* * * * *